US006374911B1

(12) United States Patent
Olson et al.

(10) Patent No.: US 6,374,911 B1
(45) Date of Patent: Apr. 23, 2002

(54) CHARGE AIR COOLER AND METHOD OF MAKING THE SAME

(75) Inventors: Gregg Olson, Racine; Brian Merklein, Grafton, both of WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/334,958

(22) Filed: Jun. 17, 1999

(51) Int. Cl.[7] ..... F28F 9/02; F28F 19/00; F28F 13/00

(52) U.S. Cl. ..... 165/173; 165/134.1; 165/135

(58) Field of Search ..... 165/173, 82, 174, 165/149, 135, 134.1

(56) References Cited

U.S. PATENT DOCUMENTS 3,326,279 A * 6/1967 Eisberg et al. ..... 165/134.1
3,633,660 A * 1/1972 Young ..... 165/173
3,993,126 A * 11/1976 Taylor ..... 165/173
4,295,522 A * 10/1981 Frei ..... 165/82
4,881,594 A * 11/1989 Beamer et al. ..... 165/173
5,214,848 A * 6/1993 Lelievre ..... 165/173
5,228,512 A * 7/1993 Bretl et al. ..... 165/173
5,630,472 A * 5/1997 Potier ..... 165/149
5,894,649 A * 4/1999 Lambert et al. ..... 165/173

FOREIGN PATENT DOCUMENTS

GB 724017 * 2/1955 ..... 165/173

* cited by examiner

*Primary Examiner*—Ira S. Lazarus
*Assistant Examiner*—Tho V Duong
(74) *Attorney, Agent, or Firm*—Wood, Phillips, Van Santen, Clark & Mortimer

(57) ABSTRACT

Thermally induced failures at the tank/header joint of a charge air cooler are reduced by applying a body of elastomer 42,54, to the side 38,53 of the inlet side header 18 to which inlet tank 10 is welded. As a consequence, the elastomer 42 causes the header 18 to operate at a lower temperature than would otherwise be the case so that its thermal expansion approximates that of the tank 10 eliminating thermal stresses at their interface.

9 Claims, 2 Drawing Sheets

CHARGE AIR COOLER AND METHOD OF MAKING THE SAME

FIELD OF THE INVENTION

This invention relates to heat exchangers, and more particularly, to charge air coolers for internal combustion engines and methods of making the same.

BACKGROUND OF THE INVENTION

For any of a variety of reasons, internal combustion engine systems are experiencing an increase in the use of turbochargers or superchargers. As is well known, a turbocharger includes a turbine wheel that is driven by the exhaust gases from the engine and which in turn drives a rotary compressor. A supercharger includes a rotary compressor which is directly driven by the engine or by a motor which is ultimately powered by the engine.

In either case, the rotary compressor compresses combustion air prior to its admission to the combustion chambers of the internal combustion engine. When a turbocharger is used, the system recovers part of the waste energy that results when incompletely spent exhaust gases are permitted to expand without performing work. Both types of system provide for higher compression ratios than are obtainable by the geometry of the internal combustion engine itself and allow the combustion of greater quantities of fuel for any given operating condition to provide an increase in engine power.

It has long been observed that when the incoming combustion air is compressed by the rotary compressor, it is simultaneously heated which, in turn, means that its density is decreased. Thus, at any given pressure, a unit volume of hot air from a turbocharger or a supercharger contains a lesser quantity of oxygen available for combustion than would an identical volume of cold air at the same pressure. This factor, in turn, places a limitation on the amount of fuel that may be burned in any given operating cycle of an internal combustion engine, which in turn limits the output thereof. Consequently, particularly in vehicular applications, a so-called charge air cooler has been introduced between compressor stages or between the compressor side of the turbocharger or supercharger and the intake manifold (or equivalent) for the internal combustion engine. The hot, combustion air from the turbocharger or the supercharger, is passed through the charge air cooler to the engine. At the same time, ambient air is passed through the charge air cooler in a flow path isolated from the combustion air, but in heat exchange relation therewith. Cooling of the combustion air is obtained to increase the density of the combustion air to ultimately provide a greater quantity of oxygen per charge of air to the engine to support the combustion of a greater quantity of fuel, increasing the output of the engine.

Charge air coolers operate in relatively stressful environments. The temperature of the charge air upon admission to the charge air cooler is typically in the range of 400–500° F. while the exterior of the charge air cooler is subjected to ambient temperatures. As a result, considerable thermal stresses may be present.

More specifically, typical charge air coolers include a plurality of generally parallel, spaced tubes with headers at opposite ends to form a core. Side pieces extend along the side of the core. Inasmuch as the charge air hot air flows through the tubes but does not contact the side pieces, the tubes tend to elongate whereas the side pieces do not. This problem has generally been solved through the use of slits extending through the side pieces to divide each side piece into two separate elements which may separate as the tubes elongate as a result of thermal expansion.

This solution has been successful in minimizing and/or eliminating failures at the tube-to-header joints. However, it does little for failures occurring elsewhere.

In other cases, particularly where extremely long tubes are employed, as for example, in radiators for locomotives, tube receiving ferules have been disposed in slots in the headers and an elastomer precision molded about each ferule to interconnect the ferules and the header. Tubes are introduced into the ferules and then soldered to the ferules. This results in a floating tube construction wherein the tubes and the ferules may move relative to the headers as a result of the pliant nature of the elastomer interconnecting the ferules and the headers. Again, this approach solves all problems at the tube-to-header joints but does not solve all the problems.

Specifically, conventional charge air coolers have opposed headers receiving the tubes, and tanks are applied to the headers on the sides thereof opposite from the tubes. Particularly at the inlet tank and header connection, where hot air from the rotary compressor of the turbocharger or supercharger is introduced, because of the greater surface area of the tank, it is more able to dissipate heat rejected to it from the incoming charge air than can the header. Since, in the usual case, the headers and the tanks are elongated, the fact that the tank is able is dissipate more heat than a header results in unequal thermal expansion in the direction of elongation of the two, resulting in failures at the header/tank connection. The present invention is directed to overcoming one or more of the above problems.

SUMMARY OF THE INVENTION

It is the principal object of the invention to provide a new and improved charge air cooler and method of making the same.

More specifically, it is an object of the invention to provide a new and improved charge air cooler construction wherein thermal expansion of the inlet header and tank are made nearly equal so as to eliminate stresses at the point where the two are joined to one another, as well as a method of making such a charge air cooler.

An exemplary embodiment achieves the foregoing object in a charge air cooler for use with an internal combustion engine that includes a pair of spaced headers. Spaced tube slots are located in each of the headers with the slots in one header being aligned with slots in the other header to receive the ends of corresponding tubes. A pair of tanks are provided, one for each header, and are metallurgically bonded to the corresponding header on one side thereof. A plurality of elongated tubes, one for each corresponding slot in the header, extend between the headers and have opposite ends received in corresponding slots in the associated headers. The tube ends pass through at least the inlet header into the corresponding tank and past the one side of the inlet header to which the tank is bonded. A fluid-type metallurgical bond is employed to secure the tube ends and the corresponding ones of the slots and fins are provided to extend between adjacent ones of the tubes and to be in heat exchange relation therewith. Tanks are provided with charge air inlets and charge air outlets as appropriate and a body of heat resistant elastomer is bonded to the side of the inlet header opposite the tubes in surrounding and contacting relation to the tube ends thereat while allowing fluid communication between the tube ends and the interior of the tank which is bonded to that header.

As a consequence, the header is insulated by the elastomer body and operates at a cooler temperature than would otherwise be the case, the cooler temperature being approximately the same as that at which the tank operates so that the two experience approximately equal thermal expansion, thereby eliminating thermal stresses at their interface.

The slots in the headers may or may not be surrounded by flanges and a body of elastomeric material may be provided, not only at the inlet header, but at the outlet header as well. Preferably, the elastomer is a silicone-based elastomer and is of a liquid type that cures at room temperature. In addition, the elastomer is preferably a flowable type so it may be cured in situ on the header to which it is applied.

It is contemplated that the headers may have edge flanges and that the body of elastomer extends along substantially the entire length of the header between the edge flanges.

According to the invention, there's also provided a method of making a charge air cooler for an internal combustion engine. The method comprises the steps of:

(a) assembling a plurality of elongated tubes to two spaced headers, each having tube receiving slots, such that the ends of the tubes extend through at least one of the headers past one side thereof;

(b) forming fluid tight metallurgical bonds between the tubes and the headers;

(c) applying a curable elastomer to at least the one side of the one header to substantially cover the same while allowing the ends of the tubes to remain open;

(d) curing the elastomer;

(e) metallurgically bonding a tank to at least the one header on the one side thereof; and (f) providing a charge air inlet in the tank.

According to a preferred embodiment of the invention, the elastomer is a flowable elastomer and step (c) is performed by flowing the elastomer onto the one side of the header. It is also contemplated that the elastomer be curable at room temperature, so that step (d) can be performed at room temperature. The invention also contemplates that the step of providing a charge air inlet be performed before the step of bonding the tanks to the headers and that the bonding steps be performed by welding or brazing.

Other objects and advantages will become apparent from the following specification taken in connection with the accompanying drawings.

DESCRIPTION OF THE PREFERRED EMBODIMENTS

Figure 1:
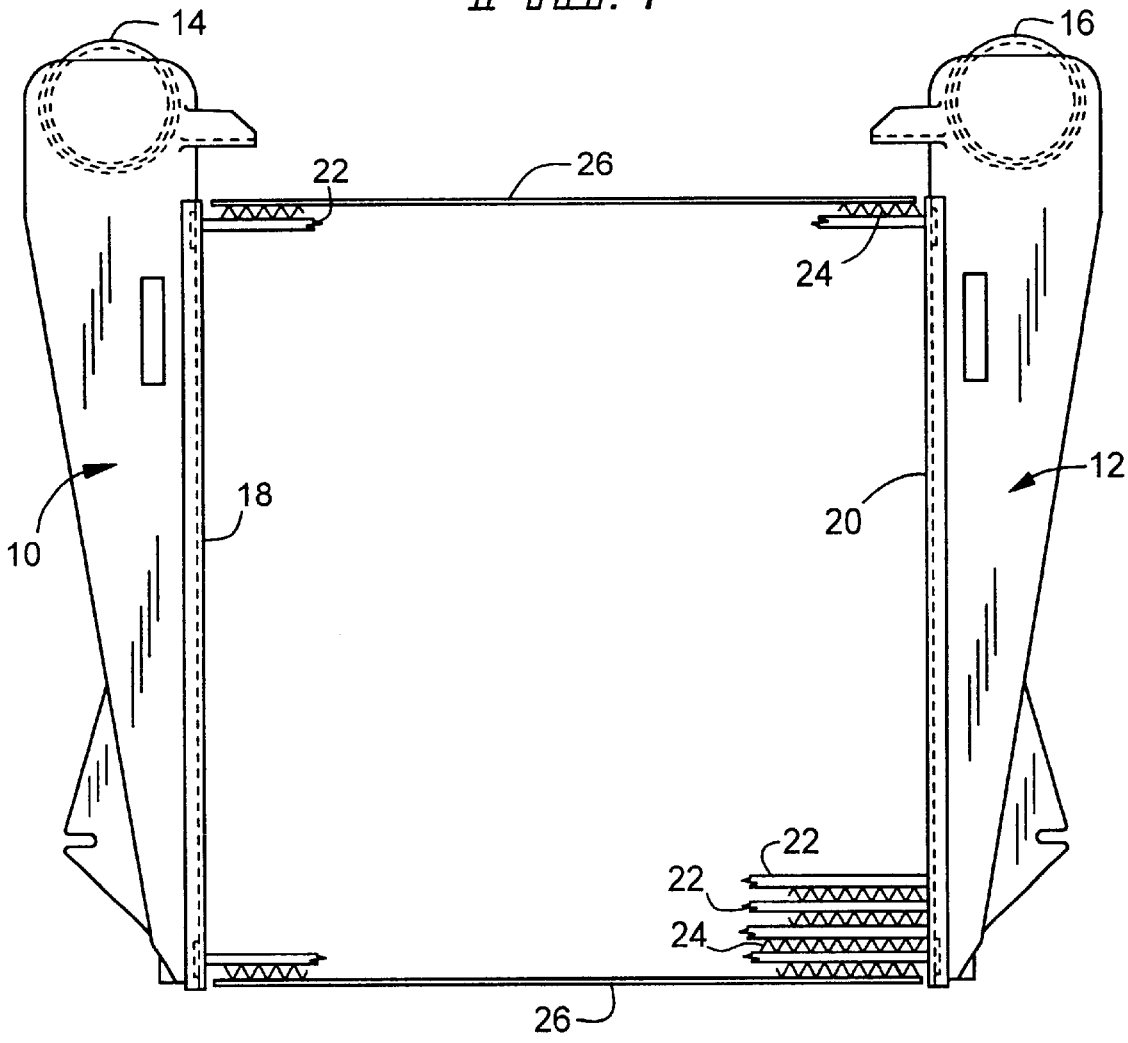
FIG. 1 is a side elevation of a charge air cooler made according to the invention.

An exemplary embodiment of a charge air cooler made according to the invention is illustrated in FIG. 1. It should be observed that the charge air cooler is basically conventional except insofar as the extension of tubes through header plates and the application of an elastomer to the headers is concerned. With that in mind, one will now be described.

The charge air cooler includes opposed tank 10,12 which typically are formed of a aluminum. The tanks 10,12 are elongated from top to bottom as illustrated in FIG. 1 and have respective rectangular openings (not shown) which extend substantially, but not entirely, the length of the respective tank 10,12. As viewed in the FIG. 1, at their upper ends, the tanks 10,12 include charge air ports 14,16. One of the ports 14,16 as, for example, the port 14, may be an inlet port and will typically be connected to the outlet of the rotary compressor of the turbocharger or supercharger with which the charge air cooler is used. The remaining port, as for example, the port 16, will be connected to the combustion air inlet of the internal combustion engine with which the charge air cooler will be used.

The aforementioned rectangular openings in the tanks 10,12 are closed by respective header plates 18,20, which will be described in greater detail hereinafter. A plurality of spaced, elongated, flattened tubes 22 extend between the header plates 18,20 and into fluid communication with the tanks 10,12 via slots to be described in the header plates 10,20. Disposed between adjacent ones of the tubes 22 and in heat exchange relation therewith, are fins 24. As illustrated in FIG. 1, the fins 24 are serpentine fins but plate fins could be used in lieu thereof. Opposite sides of the core formed by the header plates 18,20, the tubes 22 and the fins 24 include a set of the fins 22 to which a side plate 26 is metallurgically bonded. The side plates 26 are conventionally constructed so that they do not rigidly interconnect the headers 18,20, thereby allowing differential thermal expansion between the tubes 24 and the side plates 26.

Figure 2:
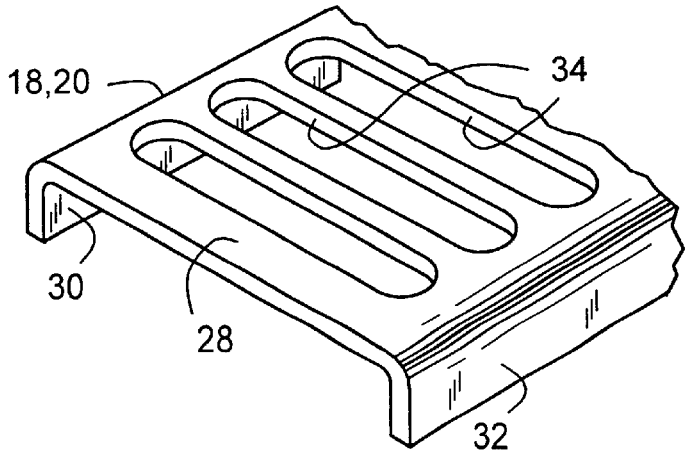
FIG. 2 is an enlarged, fragmentary view of one form of header that may be employed in the invention.

Turning to FIG. 2, one form of the headers 18,20 is illustrated. The header 18,20 is in the form of a shallow channel which is to say that the same includes a bight 28 flanked by legs 30 and 32 which act as flanges extending along the edges of the bight 28 along the entire length of the corresponding header 18,20. Tube slots 34 are formed in the bight 28 and are elongated to snuggly receive the flattened tubes 24. The tube slots 34 extend generally transverse to the direction of elongation of each of the headers 18 and 20. The tube slots 34 in the header 18 are aligned with the tube slots 34 in the header 20 to receive corresponding ones of the tubes 22.

Figure 3:
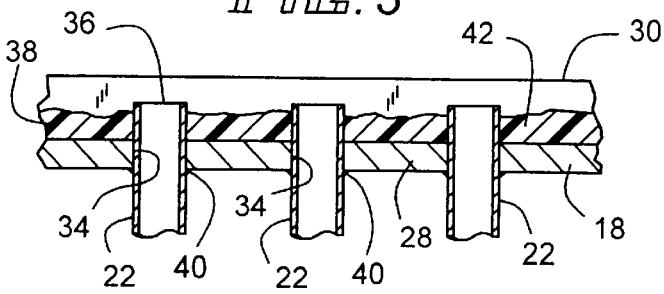
FIG. 3 is a fragmentary, sectional view of the header of FIG. 2 with tubes assembled thereto and with a layer of elastomer applied thereto.

Turning now to FIG. 3, the incorporation of the header of FIG. 2 into the heat exchanger of FIG. 1 is illustrated. As seen therein, the tubes 22 have their ends 36 extending past the surface 38 of the bight 28 between the legs 30,32 a short distance. In the usual case, the distance will be on the order of approximately ¼", although the ultimate distance selected will in part depend upon the size of the tank as well as the size of the charge air cooler itself. Desirably, the tube ends 36 are exposed but do not extend so far into the tanks 10,12 as to interface with airflow thereon. Immediately adjacent the ends 36, the tubes 22 are metallurgically bonded as, for example, by brazing, about their peripheries as shown by reference numeral 40. To this end, the tubes 22 will preferably be formed of aluminum and be braze clad as well.

Adhered to the surface 38 is a body of an elastomeric material 42. The elastomeric material 42 is temperature resistant and in a preferred embodiment, will not degrade at temperatures up to 600° F. As a consequence, it will readily withstand the 400–500° F. temperatures of incoming charge air through the inlet 14 to the header 10. The elastomer 42 contacts and surrounds, but does not cover the tube ends 36, thus allowing fluid communication between the tube ends and the interior of the tank 14.

While many types of elastomers will perform satisfactorily, it is preferred that the elastomer 42 be a silicone-based elastomer/adhesive and even more preferably, that it be a curable, flowable elastomer, and even more preferably, that it be an elastomer that will cure at room temperature. One such elastomer is identified as Superflex™ 596 High Temperature (600° F.) Low Volatile-industrial Grade-Silicone Adhesive/Sealant and available from Loctite Corporation of Rocky Hill, Conn. The body of elastomer 42 extends between the legs 30 and 32 along substantially the entire length of the header 18 and adhesively adheres thereto. However, mechanical attaching means could be used. It thus serves as an insulator to prevent direct contact of incoming charge air with the inlet header 18 with the consequence that the latter will operate at a cooler temperature than would otherwise be the case. As a result, any differential thermal expansion between the header 18 and the associated tank 10 is minimized or eliminated altogether to substantially reduce stress at their point of attachment to one another.

Figure 4:
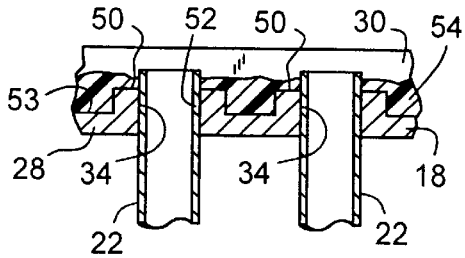
FIG. 4 is a view similar to FIG. 3 but utilizing a different header construction.

In some embodiments, the tube slots 34 may be surrounded by flanges 50 which extend in the direction of the tank, that is, upwardly between the legs 30 and 32, as illustrated in FIG. 4. In this instance, the tubes 22 are bonded metallurgically as shown at 52 to the flanges 50 as by brazing. The resulting metallurgical bond provides a fluid tight seal at the interface of the tubes 22 and the flanges 50.

A body 53 of the same elastomer used in forming the body 42 is located on the surface 54 of the bight 28 from which the flanges 50 extend. The body extends over the tops or ends of the flanges 50 and embraces the tubes 22 at the point where they emerge above the flanges 50.

Figure 5:
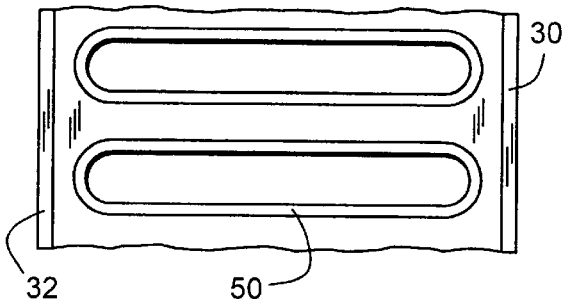
FIG. 5 is a fragmentary, plan view of one form of header that may be utilized in making the embodiment of FIG. 4.
Figure 6:
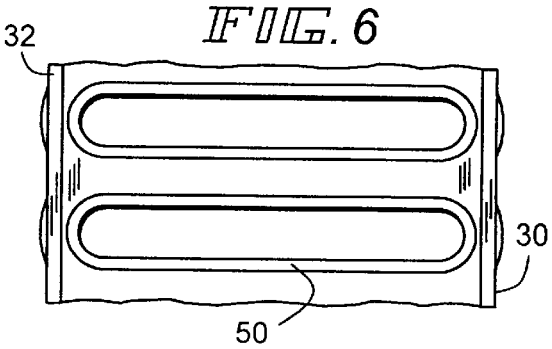
FIG. 6 is a view similar to FIG. 5 but showing another form of header that may be used in making the embodiment of FIG. 4.

Referring to FIGS. 5 and 6, in some instances, the flanges 50 will be spaced from the legs 32 as illustrated in FIG. 5 while in some instances the ends of the flanges 50 will be in substantially abutting contact with the legs 30 and 32, as shown in FIG. 6. As is well known, the orientation of the flanges with respect to the legs 30,32 shown in FIG. 6 is generally preferable in that for any given shape of a tube 22, a thinner core may be produced. On the other hand, in practicing the invention, because the ends of the flanges 50 are in substantial abutment with the legs 30,32, it is necessary to deposit the elastomer 54 between each one of the tube slots 34. In contrast, in the embodiment of FIG. 5, where the elastomer is a flowable elastomer, it may flow between the ends of the flanges and the legs 30,32 if its viscosity is not too great, simplifying its application.

Figure 7:
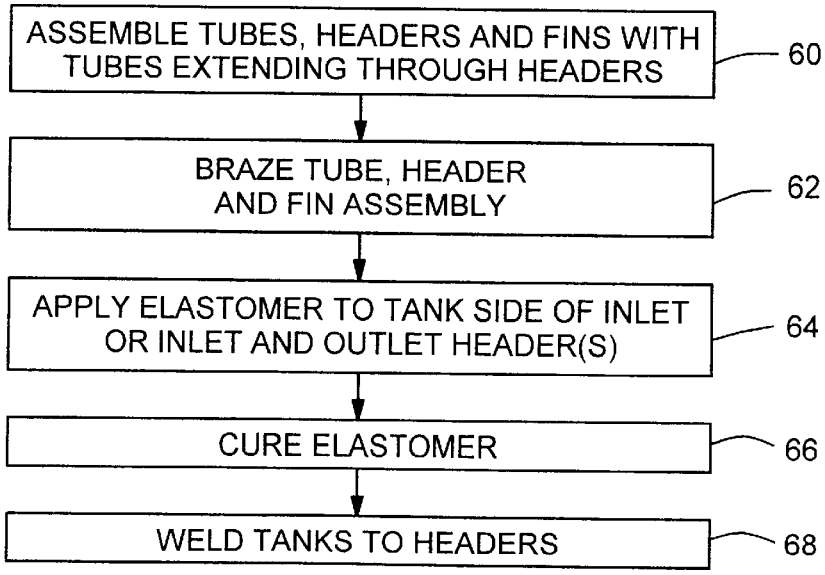
FIG. 7 is a flow diagram illustrating steps in the method of making the charge air cooler.

The general method of the invention is illustrated in FIG. 7 in block form and includes a step represented by a block 60 wherein the tubes, headers and fins are assembled in a jig or the like in a conventional fashion such that the tube ends extend through the inlet header 18 and optionally, the outlet header 20 as well.

The tube, header and fin assembly resulting from performance of the steps shown in block 60 is then subject to a metallurgical bonding process to metallurgically bond the tubes to the headers and the fins to the tubes. This step is shown by a block 62 and typically, but not always, will involve a brazing step. It is also possible that the bonds may be achieved by soldering or welding or a combination of brazing, soldering and welding.

As a result of the performance of the step indicated at block 62, a core including the headers, tubes and the fins metallurgically bonded together results. At this point, an elastomer application step shown at block 64 is performed. The elastomer is applied to the tank side of the inlet header 18, or the tank side of both the inlet header 18 and the outlet header 20 if desired. The points of application of the elastomer will in large part depend upon the type of header selected, as well as the viscosity of the flowable elastomer. It is necessary that the elastomer cover and itself bond to the bight 28 of the associated header 18 or 20 along substantially its entire length and extend between the legs 30 and 32 and the flanges 50, if present.

Once the elastomer has been applied, a curing step shown at block 66 may be performed. As mentioned previously, it is preferable that the elastomer be of the type that will cure at room temperature, thereby allowing the core with the elastomer applied simply to be set aside for a relatively short period of time, as, for example, 24 hours, until the cure is effected. Once that has occurred, the tanks 10,12 may be applied to the headers 18,20 respectively in a conventional fashion and metallurgically bonded thereto. Again, this operation will typically involve brazing or welding and more typically welding. In this regard, the elastomer 42,54 will not be disturbed by the bonding process and any heat accompanying the same because of its temperature resistance.

From the foregoing, it will be appreciated that the resulting charge air cooler will have an inlet side header that is insulated from the high temperature charge air entering the charge air cooler such that the thermal expansion of the header during operation will approximate that of the tank to which it is attached. Thus, thermally induced stresses where the tank 10 is bonded to the header 18 are substantially reduced or eliminated altogether. As a consequence, use of the invention, failure rates have been substantially reduced.

Three charge air coolers, two made according to the invention and one without the body of elastomer, were subjected to thermal cycling and then pressure tested. Thermal cycling involved introducing 125° F. air into the charge air cooler, raising the temperature of the air to 500° F., and then reducing the air temperature to the 125° F. Each cycle was performed in one minute and repeated at least 40,000 times while 125° F. air was being flowed through the exterior of the charge air cooler.

Pressure testing involved application of 35 psig air to the interior of the charge air cooler, halting the introduction of pressurized air and observing the internal pressure after 15 seconds. No more than 4.0 psi should be lost or the charge air cooler is regarded as substandard.

In one test, a charge air cooler made according to the invention showed no pressure loss when pressure tested at over 44,600 cycles. In another, a charge air cooler made according to the invention experienced only a 0.5 psi pressure loss. It had undergone over 40,600 thermal cycles. In this case, the leaks appeared to be due to failures in the metal forming the tubes 22, rather than any failure at the header/tank interface. The conventional charge air cooler experienced a 4.0 psi pressure loss after having been thermally cycled slightly over 40,000 times. Multiple header cracks were observed in this charge air cooler.

The benefits of the use of the elastomer are, therefore, apparent.

What is claimed is:

1. A charge air cooler for use with an internal combustion engine comprising:

a pair of spaced, metal headers;

spaced tube slots in each of said headers, with the slots in one header being aligned with slots in the other header to receive the ends of corresponding tubes;

a pair of metal tanks, one for each header, metallurgically bonded to the corresponding headers on one side thereof;

a plurality of elongated, metal tubes, one for each of the aligned slots in a header, extending between the headers and having opposite ends received in corresponding slots in the associated headers, said tube ends passing through at least said one header into the associated tank and past said one side of said one header;

fluid tight metallurgical bonds securing said tube ends in the corresponding ones of said slots;

fins extending between and in heat exchange relation with adjacent ones of said tubes;

a charge air inlet to the tank bonded to said one header;

a charge air outlet from the other of said tanks; and a body of heat resistant elastomer secured to said one side of at least said one header in surrounding and contacting relation to the tubes ends thereat while allowing fluid communication between said tube ends and the interior of the tank bonded to said one header.

2. The charge air cooler of claim 1 wherein said slots are surrounded by flanges on said headers and said tube ends are bonded to said flanges.

3. The charge air cooler of claim 2 wherein said flanges are on the sides of said headers to which said tanks are bonded.

4. The charge air cooler of claim 3 wherein said flanges are covered by said body of elastomeric material.

5. The charge air cooler of claim 1 wherein said elastomer is a silicone based elastomer.

6. The charge air cooler of claim 1 wherein said elastomer is of a liquid type that cures at room temperature and said body is cured in situ on said one header.

7. The charge air cooler of claim 1 wherein there are two of said bodies, one on each of said headers.

8. The charge air cooler of claim 1 wherein said headers are elongated and have edge flanges on their edges that extend in their direction of elongation; said slots are elongated in a direction transverse to said direction of elongation; tube slot flanges surrounding each of said slots; and said body extends along substantially the entire length of said one header between said edge flanges and said tube slot flanges.

9. The charge air cooler of claim 8 wherein said tube slot flanges are spaced from said edge flanges and said elastomer is flowable in an uncured state and cured in situ on said one header one side.

* * * * *